United States Patent [19]

Otoshima

[11] Patent Number: 4,607,482

[45] Date of Patent: Aug. 26, 1986

[54] FLUID YARN SPLICING DEVICE

[75] Inventor: Hiroo Otoshima, Shiga, Japan

[73] Assignee: Murata Kikai Kabushiki Kaisha, Japan

[21] Appl. No.: 700,687

[22] Filed: Feb. 12, 1985

[30] Foreign Application Priority Data

Feb. 16, 1984 [JP] Japan ..... 59-27877

[51] Int. Cl.[4] ..... D01H 15/00; B65H 69/06

[52] U.S. Cl. ..... 57/22; 57/261

[58] Field of Search ..... 57/22, 261, 263; 242/35.6 R, 37 A

[56] References Cited

U.S. PATENT DOCUMENTS 4,263,775 4/1981 Mima ..... 57/22

4,344,277 8/1982 Rohner et al. ..... 57/22

4,408,442 10/1983 Rohner ..... 57/22

4,481,761 11/1984 Kimura ..... 57/22

*Primary Examiner*—John Petrakes

*Attorney, Agent, or Firm*—Spensley Horn Jubas & Lubitz

[57] ABSTRACT

Device for splicing yarns together by subjecting the superposed ends of yarns to the action of a compressed fluid. A fluid supply system of a fluid treatment section having a yarn splicing member for making a jet of a fluid act on the overlapping section of two yarn ends, and untwisting nozzles for untwisting the yarn ends, and a functional system of a yarn end control unit for cutting and locating the yarn ends are connected to a single driving source.

10 Claims, 24 Drawing Figures

300

74

26
ℓ1
74
90

74
25
26
ℓ2
90

74
25
ℓ3
90

92
25
74
ℓ4
90

FLUID YARN SPLICING DEVICE

BACKGROUND OF THE INVENTION

The present invention relates to a fluid yarn splicing device. In a yarn winding process, when end breakage occurred, the yarn ends are pieced together automatically or by an operator, and then the yarn winding operation is restarted. Mechanical knotters capable of forming a weaver's knot or a fisherman's knot are well-known automatic yarn piecing devices and employed generally in the conventional automatic winders. However, those mechanical knotters have a serious disadvantage that the knot is almost three times as large as a single yarn. Accordingly, such large knots cause yarn breakages in knitting and weaving processes or knots appear on the surface of fabrics and require to be concealed in the backside.

A method and an apparatus for splicing yarns in a joint which is entirely different either from the weaver's knot or from the fisherman's knot in construction have been proposed to overcome such a disadvantage of the conventional knotter. According to the proposed yarn splicing method, yarns are spliced together by subjecting the superposed ends of the yarns to the action of a compressed fluid so that the ends are mixed and the respective component fibers are intertwined.

A yarn splicing device for carrying out such a method needs to be equipped with a driving mechanism for driving a yarn end control unit including a lever which engages directly and guides a yarn, and a fluid supply mechanism for supplying a fluid that acts on yarn ends. A new automatic yarn winder equipped with such mechanisms is able to form a desirable joint. However, it is extremely difficult to incorporate a new yarn splicing device additionally into an existing automatic winder not equipped with any fluid yarn splicing device and installed in a plant, so to speak, an old automatic yarn winder, and yet such an old automatic yarn winder is desired to operate as ever.

SUMMARY OF THE INVENTION

The present invention has been made in view of such problems. Accordingly, it is an object of the present invention to provide a portable fluid yarn splicing device of a compact construction, capable of forming a satisfactory spliced joint.

According to the present invention, a driving system for driving yarn guide levers and cutters, and a splicing fluid supply system are connected directly to a single driving source so that the device is assembled in a compact construction.

According to the present invention, the fluid supply system of the fluid treatment section having a yarn splicing member for making a jet of a fluid act on the overlapping section of two yarn ends, and untwisting nozzles for untwisting the yarn ends, and the functional system of the yarn end control unit for cutting and locating the yarn ends are connected directly to a single driving source. Accordingly, the yarn splicing device of the present invention is extremely compact in construction, readily portable, capable of being carried to a desired place, instead of being incorporated into a textile machine, such as a yarn winder, to splice yarns in a knotless form, and, in particular, capable of being used in the existing spinning mills and weaving mills.

BRIEF DESCRIPTION OF THE DRAWINGS

FIGS. 1 to 9 show a first embodiment of the present invention, in which:

FIG. 1 is a schematic plan view showing the general constitution;

FIG. 2 is a front elevation showing the general external form;

FIG. 3 is a sectional front view taken on line III—III of FIG. 1, showing the yarn splicing hole and the untwisting nozzle of the yarn splicing section;

FIG. 4 is a plan view of the block fixedly mounting the yarn splicing member;

FIG. 5 is a front elevation showing the operating mechanism of one of the yarn end control units, i.e., the yarn end control unit;

FIG. 5A is a diagram explaining the mechanism of yarn end cutting and gripping;

FIG. 6 is a front elevation showing the operating mechanism of the other yarn end control unit;

FIG. 6A is a diagram explaining the operating timing of the swing member and the yarn handling lever;

FIG. 7 is a front elevation of the essential part of the yarn holding device;

FIG. 8 is a sectional front elevation of the fluidic cylinder functioning as a single driving source for driving both the fluid treatment unit and the yarn end control units; and FIG. 9 is an explanatory diagram showing the positional relation between the fluid passages of the fluidic cylinder of FIG. 8;

FIGS. 10 to 13 show a second embodiment of the present invention, in which:

FIG. 10 is a sectional front elevation of the rotary cylinder functioning as a single driving unit;

FIG. 11 is a fragmentary sectional side elevation of the rotary cylinder of FIG. 10;

FIG. 12 is a front elevation of one of the yarn end control unit; and

FIG. 13 is a front elevation of the other yarn end control unit;

DETAILED DESCRIPTION OF THE INVENTION

A preferred embodiment of the present invention will be described hereinafter in connection with the accompanying drawings.

Figure 1:
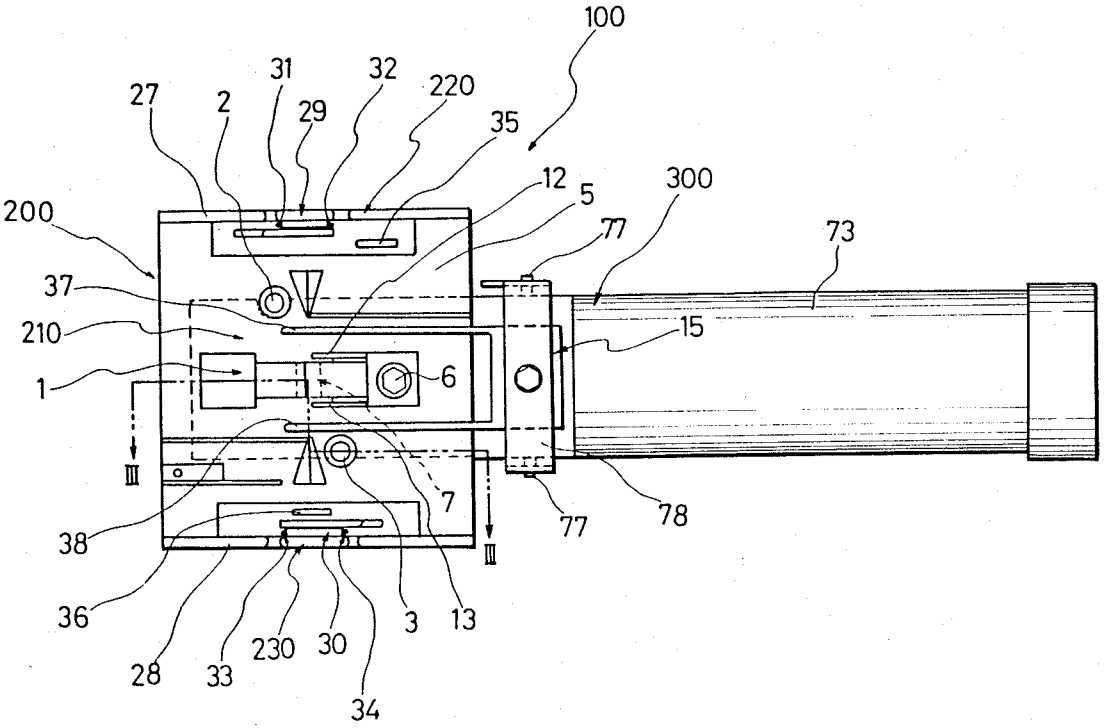
Figure 2:
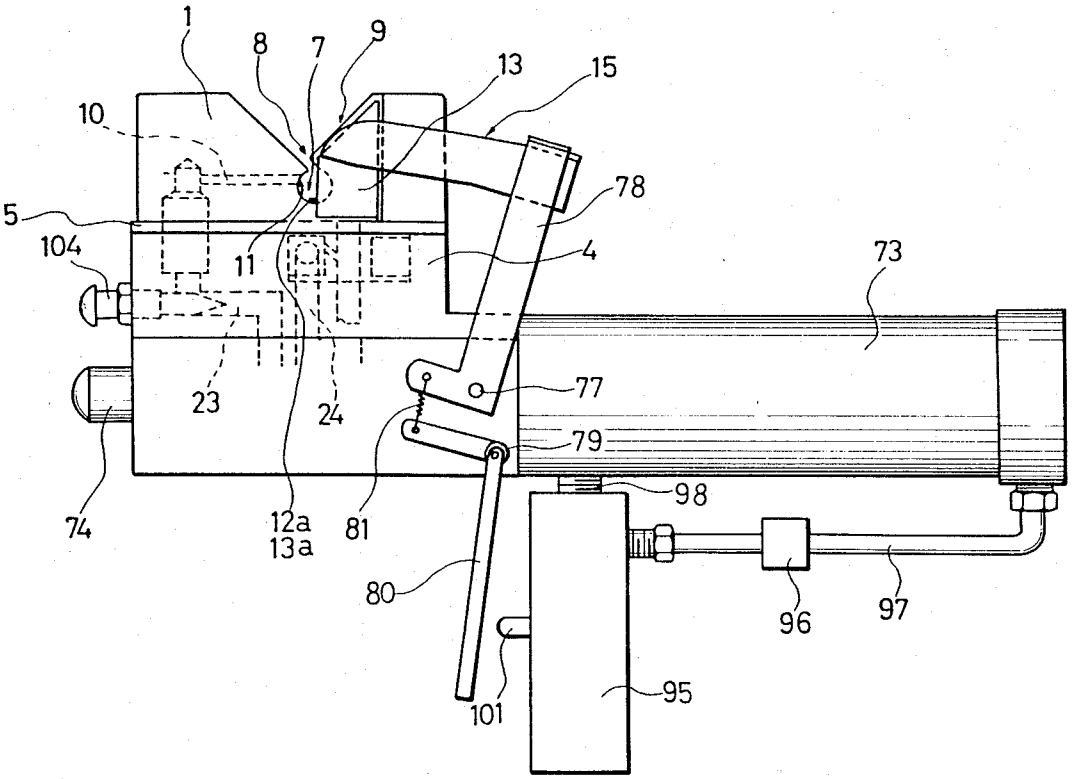

FIGS. 1 and 2 are general views of a yarn splicing device 100. The yarn splicing device 100 consists of a yarn splicing section 200 and a driving section 300. The yarn splicing section 200 consists of a fluid treatment unit 210 and yarn end control units 220 and 230. The driving section 300 supplies a fluid to the fluid treatment unit 210 and drives the levers of the yarn end control units 220 and 230. In splicing two yarns together in the yarn splicing section 200, the respective ends of the yarns are cut, clamped and located in the yarn end control units 220 and 230 respectively, then the yarn ends are untwisted into fibers by means of yarn end untwisting nozzles of the fluid treatment unit 210, and then the untwisted yarn ends are subjected to the action of the flow of a yarn splicing fluid for splicing.

The components of the fluid yarn splicing device will be described in detail hereunder.

(I) Yarn Splicing Section (200)

(a) Fluid Treatment Unit (210)

Basically, the fluid treatment unit 210 consists of a yarn splicing member 1 and yarn end untwisting nozzles 2 and 3. As shown in FIGS. 1 and 2, the yarn splicing member 1 is fixed with screws 6 to a top plate 5 fixed to a block 4 and has a yarn splicing hole 7 penetrating therethrough. A yarn end inserting slit 8 opens into the yarn splicing hole 7, while a yarn guide groove 9 merges into the slit 8. A fluid supply passage 10 is formed through the yarn splicing member 1 and a fluid exit 11 opens into the yarn splicing hole 7.

The fluid exit 11 is formed radially or tangentially with respect to the cylindrical yarn splicing hole 7. The cross section of the fluid exit may be circuit or flat-form, such as elliptical, rectangular or slot-form and a single fluid exit may be formed practically at the longitudinal central position of the yarn splicing hole 7 or a plurality of fluid exits may be formed at a plurality of positions in the yarn splicing hole 7, in compliance with the type and the count of the yarn to be treated. For thick yarns, such as yarns of count Nm 10 or below, in particular, a fluid exit of a laterally expanded cross section is more effective.

Control plates 12 and 13 are screwed through spacers to the opposite sides of the yarn splicing member 1. The control plates 12 and 13 are located so that the respective specific edges 12*a* and 13*a* thereof extend across the end openings of the yarn splicing hole 7 respectively. The control plates 12 and 13 locate yarn ends in the yarn splicing hole 7 in cooperation with a yarn holding device 15, which will be described later, prevent the yarn end from being blown out of the yarn splicing hole 7 by the fluid flowing out from the yarn splicing hole 7, and control the flow of the fluid through the opposite end openings of the yarn splicing hole 7 to achieve the satisfactory entanglement of the yarn ends and the entwinement of the fibers.

Figure 3:
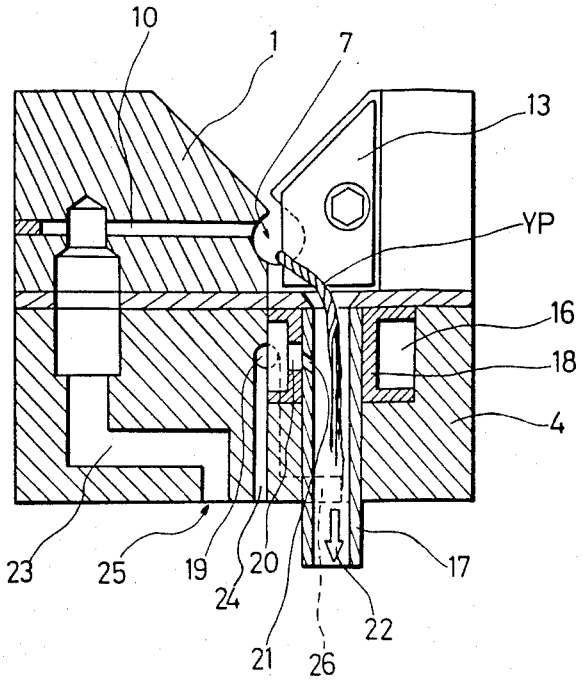

The yarn end untwisting nozzles 2 and 3 are disposed on opposite sides of the yarn splicing member 1 in point symmetry. The respective fluid flows produced within the yarn end untwisting nozzles 2 and 3 untwist the respective ends of yarns to be spliced together into collections of parallel fibers to prepare optimal yarn ends for a joint. One of the yarn end untwisting nozzles 2 and 3, for example, the yarn end untwisting nozzle 3, is formed, as shown in FIG. 3, by fixing a guide 18, having a sleeve 17 inserted therethrough, in a concavity 16 formed in the block 4. The concavity 16 serves as a fluid passage 16. A compressed fluid, preferably, compressed air, supplied through a fluid supply passage 19 opening into the fluid passage 16 is injected through a bore 20 and an inclined bore 21 into the interior of the sleeve 17 and flows in a direction indicated by an arrow 22 producing a suction at the upper opening of the sleeve 17. Thus a yarn end YP is sucked into the sleeve 17 and untwisted.

The free yarn end YP sucked into the sleeve 17 is untwisted by the compressed fluid injected through the inclined bore 21 into the sleeve 17. Since the yarn end YP is twisted in "Z-twist" or in "S-twist", the position of the inclined bore 21 needs to be adjusted according to the type of the twist so that the compressed fluid is injected in a direction for untwisting the yarn end YP.

Figure 4:
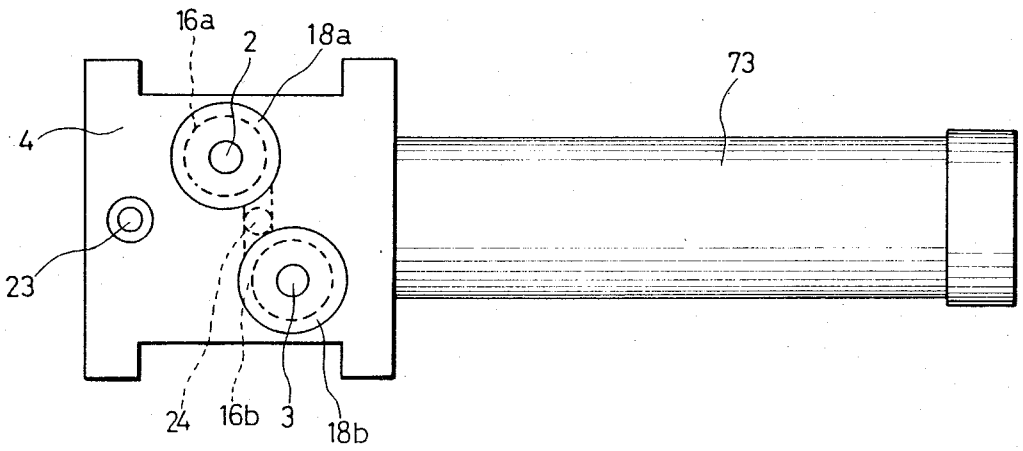

The compressed fluid is supplied to the yarn splicing hole 7 and the untwisting nozzles 2 and 3 through fluid passages 23 and 24 formed in the block 4 as shown in FIGS. 3 and 4. The fluid passage 23 is a single passage with the bottom opening 25 connected to the driving section, which will be described later. The fluid passage 24 for supplying the fluid to the untwisting nozzles is branched to be connected to fluid passages 16*a* and 16*b* formed in the guide members 18*a* and 18*b* of the untwisting nozzles 2 and 3 respectively.

(b) Yarn End Control Units

In a yarn winder, for instance, the yarn end control units 220 and 230 cut and grip the yarn end on the package-side and the yarn end on the bobbin-side, control the respective lengths of the yarn ends to be sucked into the untwisting nozzles and the length of the overlap in the yarn splicing hole 7, and locate the yarn ends in the yarn splicing hole 7. In FIG. 1, the yarn end control units 220 and 230 are disposed on the opposite sides of the fluid treatment unit 210. The yarn end control units 220 and 230 comprise fixed guide plates 27 and 28, yarn cutting devices 29 and 30 disposed between the guide plates 27 and 28 and the untwisting nozzles 2 and 3, yarn end gripping devices, 31, 32 and 33, 34 yarn handling levers 35 and 36, and yarn holding levers 37 and 38 disposed between the yarn splicing member 1 and the untwisting nozzles 2 and 3, respectively.

Figures 5, 5A:
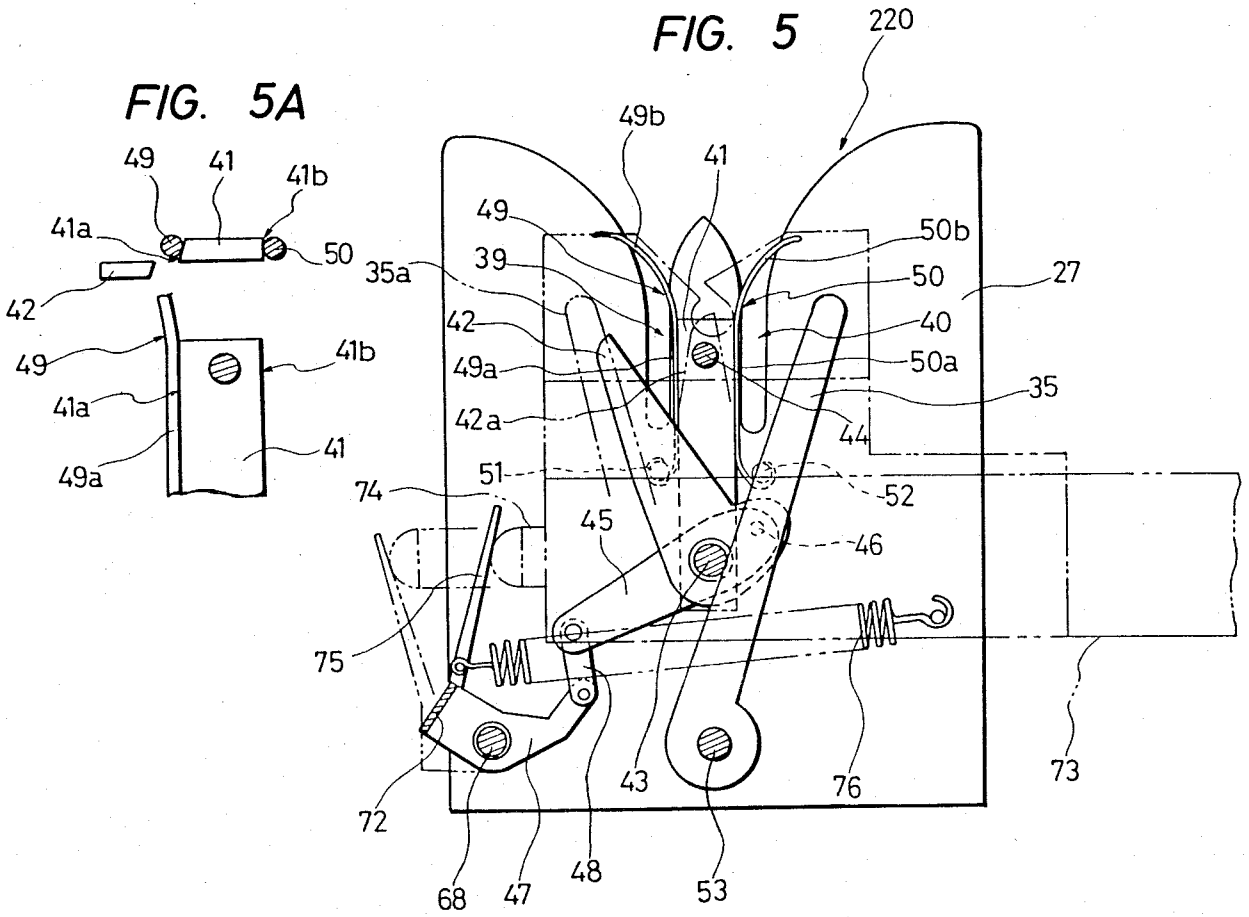

One of the yarn end control units, namely, the yarn end control unit 220 will be described in detail with reference to FIGS. 1 and 5. Guide grooves 39 and 40 for guiding and locating two yarn ends are formed in the guide plate 27, which is fixed to the side surface of the block 4. A fixed blade 41 and a movable blade 42 of the yarn cutting device 29 are attached to one side surface of the guide plate 27. The fixed blade 41 is disposed at the middle position between the guide grooves 39 and 40 by means of a shaft 43 and a screw 44. As shown in FIG. 5A, a cutting edge and a yarn end gripping surface are formed on one end surface 41*a* and a yarn end gripping surface is formed on the other end surface 41*b* of the fixed blade 41. The movable blade 42 is supported rotatably on the shaft 43 and linked with a lever 45 by means of a pin 46. The movable blade 42 swings between a position 42 indicated by a solid line and a position 42*a* indicated by a broken line as the lever 45 swings to cut only the yarn end located in the guide groove 39. The movable blade 42 is driven through a swing member 47 adapted to be actuated by the advancement of the piston rod of a fluidic cylinder, which will be described later, a link plate 48 and the lever 45.

Spring wires 49 and 50 are pressed against the end surfaces 41*a* and 41*b* of the fixed blade 41 and fixed to the guide plate 27 by means of screws 51 and 52 respectively, to constitute the yarn end gripping devices 31 and 32 as shown in FIG. 1. The spring wires 49 and 50 have yarn gripping sections 49*a* and 50*a* and guide sections 49*b* and 50*b* crossing the corresponding guide grooves 39 and 40 respectively. The yarn ends guided into the guide grooves 39 and 40 are gripped between the end surfaces 41*a* and 41*b* of the fixed blade 41 and the gripping sections 49*a* and 50*a* respectively.

The yarn handling lever 35 is fixed to a shaft 53 penetrating through the guide plates 27 and 28 so as to act on the yarn received in the guide groove 40. As the yarn handling lever 35 is turned to a position 35*a* indicated by an alternate long and two short dashes line, the yarn end of the yarn received in the guide groove 40 is drawn out from the untwisting nozzle 3 to decide the length of overlap in the yarn splicing hole 7. The yarn handling lever 35 is moved together with the other yarn handling lever also fixed to the shaft 53 at an appropriate timing so that the yarns are drawn out after the respective yarn ends of the yarns have been untwisted in the untwisting nozzles 2 and 3 in a condition suitable for yarn splicing.

Figures 6, 6A:
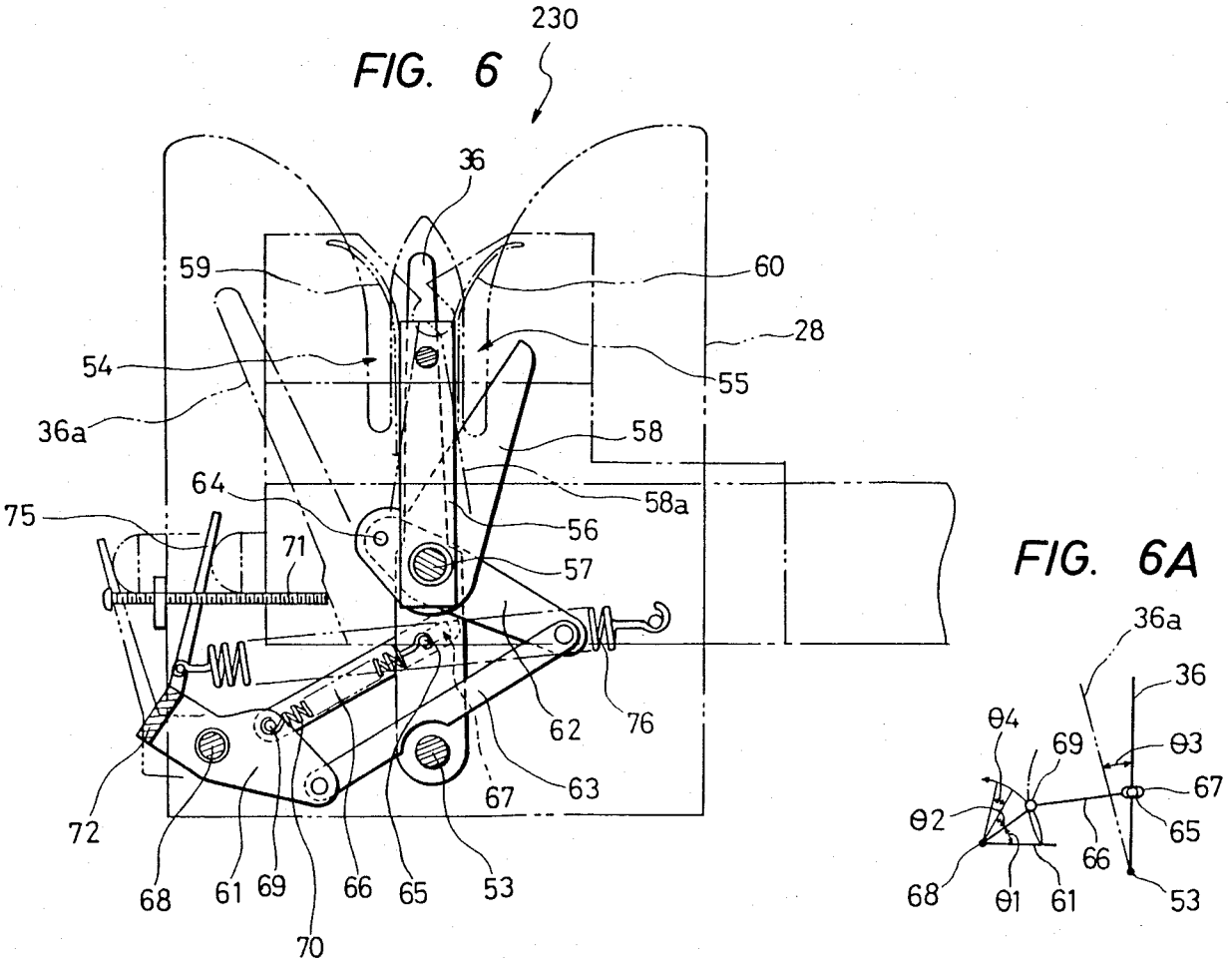

The other yarn control unit 230 is shown in FIG. 6. Referring to FIGS. 1 and 6, guide grooves 54 and 55 are formed in the guide plate 28 fixed to the other side of the block 4, similarly to those formed in the guide plate 27. A fixed blade 56 fixed to one side surface of the guide plate 28 and a movable blade 58 supported on a shaft 57 constitute the yarn cutting device 30. Spring wires 59 and 60 pressed against the opposite end surfaces of the fixed blade 56 constitute the yarn end gripping devices 33 and 34 shown in FIG. 1. The yarn handling lever 36 which acts on the yarn received in the guide groove 54 is fixed to the shaft 53. As the yarn handling lever 36 is moved from a position 36 indicated by a solid line to a position **36*a* indicated by an alternate long and two short dashes line, the untwisted yarn end of the yarn received in the guide groove 54 is drawn out from the untwisting nozzle 2. As the movable blade 58 moves from a waiting position 58 indicated by a solid line to a position 58*a* indicated by an alternate long and two short dashes line, the yarn received in the guide groove 55** is cut.

The movable blade 58 and the yarn handling lever 36 are actuated by a swing member 61 formed integrally with the swing member 47 shown in FIG. 5. That is, a lever 62 fitted loosely on the shaft 57 supporting the movable blade 58, and the swing lever 61 are linked by a link plate 63, the lever 62 and the movable blade 58 are joined with a pin 64, and a delaying link 66 is extended between the swing member 61 and a pin 65 fixed to the yarn handling lever 36. The pin 65 fixed to the yarn handling lever 36 is received in a slot 67 formed in the delaying link 66. A connecting pin 69 is located on the swing member 61 so that, at the start of turning of the swing member 61 on the shaft 68 in a counterclockwise direction, only the movable blade 58 is caused to start turning simultaneously with the swing member 61 through the link plate 63, whereas the yarn handling lever 36 remains at the waiting position 36. That is, as shown in FIG. 6A, while the swing member 61 turns through an angle $\theta_1$ the movement of the connecting pin 69 only causes the delaying link 66 to turn about the pin 65 fitted in the slot and does not cause the pin 65 to move. As the connecting pin 69 turns further over the angular position $\theta_1$ through an angle $\theta_2$, the spring 70 causes the pin 65 to move about the shaft 53 so as to follow the movement of the dealing link 66, so that the yarn handling lever 36 is turned through an angle $\theta_3$. The angle $\theta_1$ of turning of the swing member 61 is decided in relation with a time during which the yarn ends of the yarns to be spliced together are cut at a position away from the gripped position by a preset distance, the yarn ends are sucked into the untwisting nozzles 2 and 3, and the yarn ends are untwisted in a desired condition in the untwisting nozzles 2 and 3. The angle $\theta_3$ corresponds to the angle of turning of the yarn handling lever 36 necessary for drawing out the yarn end from the untwisting nozzle. The slot 67 formed in the delaying link 66 is provided to allow the further turning of the swing member 61 and to hold the yarn handling lever 36 stopped, during the yarn splicing operation in the yarn splicing hole 7 by jetting the fluid, after the swing lever has turned through the angle $\theta_2$ over the angular position $\theta_1$ and the yarn handling lever 36 has been brought into abutment with a stopper, which will be described later, at the position **36*a*. The further turning of the swing member 61 through an angle $\theta_4$ causes the delaying link 66 to move by a distance corresponding to the length of the slot 67**.

The yarn handling levers 35 (FIG. 5) and 36 are fixed to the opposite ends of the shaft 53, and hence the yarn handling levers 35 and 36 are turned concurrently. The turning angle of the yarn handling levers 35 and 36, namely, the length of the yarn ends to be drawn out from the untwisting nozzles, is decided by means of an adjustable stopper 71 (FIG. 6) which limits the turning of the yarn handling lever 36, and thereby the length of overlap of the yarn ends is decided. The optimum length of overlap can be decided by adjusting the position of the extremity of the stopper 71 in compliance with the type and count of the yarn.

A connecting member 72 is extended between and fixed to the swing members 47 and 61 (FIGS. 5 and 6). A finger 75 is fixed to the central part of the connecting member 72 so as to be in contact with the piston rod 74 of a cylinder 73. The advancement of the piston rod 74 causes the swing members 47 and 61 to swing. A spring 76 is extended between the finger 75 and the cylinder 73 or between the finger 75 and the guide plate 27 to retract the piston rod 74 positively.

Figure 7:
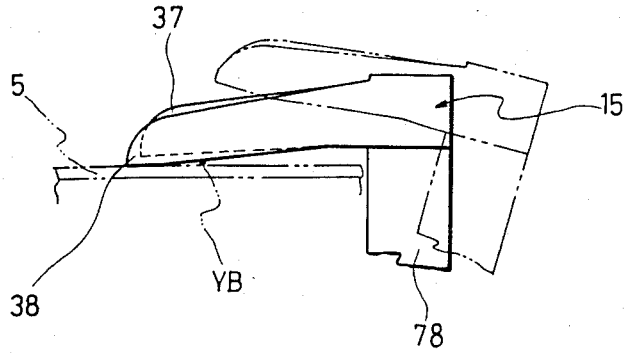

In FIGS. 1 and 2, the yarn holding plate 15 is disposed between the yarn splicing member 1 and the untwisting nozzles 2 and 3. In splicing yarns, the yarn holding device 15, in cooperation with the yarn handling levers 35 and 36, sets the untwisted yarn ends in the yarn splicing hole 7 and controls the relative position between the yarns. The yarn holding device 15 comprises a swing lever 78 swingable on a fixed shaft 77, yarn holding plates 37 and 38 screwed to the swing lever 78 and an operating lever 80 swingable on a fixed shaft 79 and connected to the swing lever 78 by a spring 81. The yarn holding device 15 functions only when the operating lever 80 is actuated. As shown in FIG. 7, the yarn holding plates have the form of a fork toward the free end. The yarn holding plates 37 and 38 are slightly different from each other in shape. When the swing lever 78 swings to an extent where the yarn holding plate 38 is in contact with the upper surface of a top plate 5 and the yarn YB is held between the upper surface of the top plate 5, the control plate 13 and the yarn holding plate 38, a clearance is formed between the yarn holding plate 37 and the upper surface of the top plate 5, so that the position of the yarn is controlled only in a direction perpendicular to the yarn.

In splicing the yarns, the action of the compressed fluid causes the balooning of the yarn ends, and one of the yarns is untwisted by the action of the balooning. The yarn holding plates 37 and 38 of the yarn holding device 15 hold the yarns to check the propagation of the untwisting. Accordingly, the yarn holding plates 37 and 38 are required to apply only a moderate pressure sufficient to check the propagation of the untwisting to the yarns. The application of an excessive pressure to the yarns makes the yarns fluffy, and is not desirable. On the other hand, since the other yarn is caused to rotate in a twisting direction by the action of the balooning, this yarn need not necessarily be held and needs only to be held for positional control.

(II) Driving Section

Figure 8:
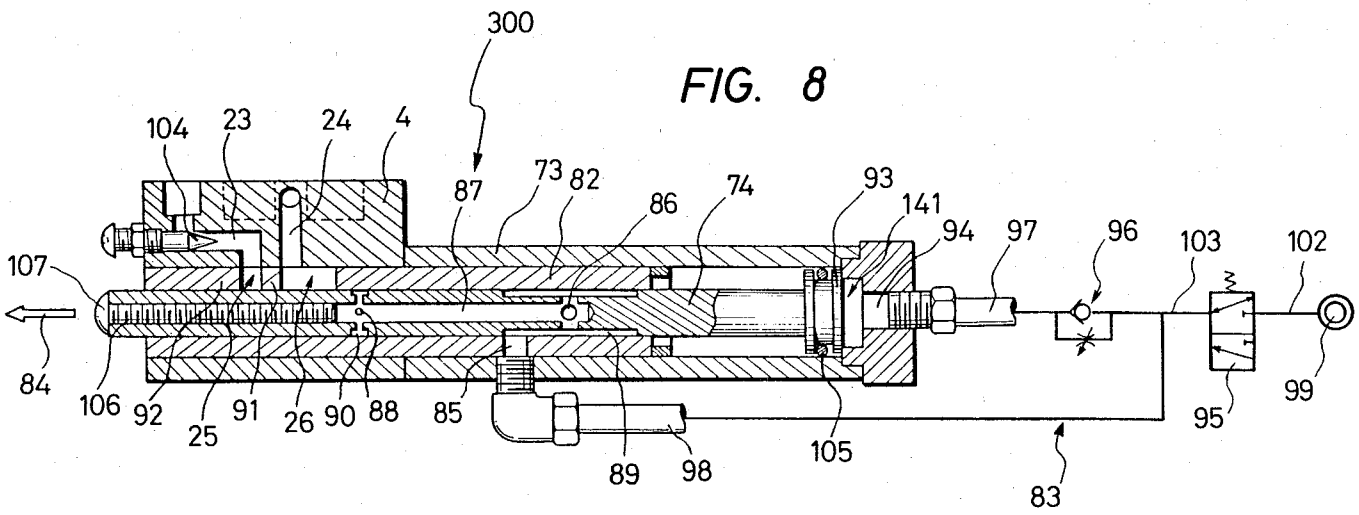

The driving section 300 which supplies the compressed fluid to the fluid treatment unit 210, namely, to the yarn splicing hole 7 of the yarn splicing member 1 and to the untwisting nozzles 2 and 3, and drives the component levers of the yarn end control unit 220 is shown in FIG. 8.

The driving section 300 comprises, generally, the cylinder 73 practically formed in a unit with the yarn splicing section supporting block 4, the piston rod 74 fitted in the cylinder 73, a tubular body 82 interposed between the cylinder 73 and the piston rod 74, and a fluid supply pipe 83.

The fluid passage 24 for supplying the compressed fluid to the untwisting nozzles 2 and 3, and the fluid passage 23 for supplying the compressed fluid to the yarn splicing hole 7 are formed in the block 4. The fluid passage 23 and 24 communicate with openings 25 and 26, respectively, formed in the wall of the tubular body 82 attached closely to the block 4. The openings 25 and 26 are arranged in the order of the opening 26 and the opening 25 with respect to the direction 84 of the advancement of the piston rod 74 for yarn splicing operation. The respective lengths (a) and (c) of the openings 26 and 25 are proportional to the untwisting time (T) and the yarn splicing time (t). For example, when $T=3t$, then $a=3c$. The advancing speed of the piston rod 74 is regulated at a fixed speed by means of a speed controller, which will be described later.

A fluid supply port 85 is formed in the tubular body 82. The compressed fluid supplied through the fluid supply port 85 flows into a hollow chamber 87 formed in the piston rod 74 through an inlet port 86 formed in the rear section of the piston rod 74 and then flows out through an outlet port 88 formed in the front section of the piston rod 74. Therefore, only when the outlet port 88 coincides with the opening 26 or 25 of the tubular body 82, the compressed fluid flows into the fluid passage 24 or the fluid passage 23.

The inlet port 86 and outlet port 88 formed in the piston rod 74 have a plurality of through holes formed at angular intervals practically at the widthwise center of circumferential annular grooves 89 and 90 of b1 and d2 width respectively. Accordingly, when the annular groove 89 coincides with the fluid supply port 85, the fluid flows into the hollow chamber 87, and only when the annular groove 90 coincides with the opening 26 or 25, the compressed fluid flows out from the hollow chamber 87.

Figure 9:
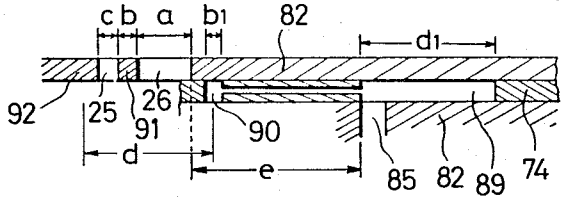

FIG. 9 shows the relation the openings 26 and 25, the annular grooves 89 and 90 in position and longitudinal size. The width b1 of the annular groove 90 is equal to or smaller than the wall length (b) between the openings 26 and 25. The width d1 of the annular groove 89 of the inlet port 86 is equal to or greater than the total stroke (d) of the piston rod 74. That is, $b1 \leqq b$ and $d1 \geqq d$. The distance (e) between the rear edge of the opening 26 and the front edge of the annular groove 89 is greater than the width d1 of the annular groove 89. Accordingly, while the piston rod 74 advances through a distance corresponding to the stroke (d), the fluid supply port 85 keeps communicating with the inlet port 86, and hence the compressed fluid is supplied into the hollow chamber 87. As the annular groove 90 of the piston rod 74 moves sequentially to the opening 26, the wall 91, the opening 25, and then to the wall 92, the sequential supply and the interruption of supply of the fluid to the fluid treatment unit of the yarn splicing section are controlled in the sequence of fluid supply to the untwisting nozzles 2 and 3→ interruption of fluid supply to the untwisting nozzles→ fluid supply to the yarn splicing hole 7→ interruption of fluid supply to the yarn splicing hole.

A fluid supply port 94 is formed at the rear end of the cylinder 73 to supply a compressed fluid into the cylinder 73 to apply pressure to a piston 93. The fluid supply port 94 is connected by a pipe 97 through a speed controller 96 and a selector valve 95 to a fluid supply source 99. The selector valve 95 is connected by a pipe 98 to the fluid treatment unit. Thus the compressed fluid is supplied to the pipes 97 and 98 from the common fluid supply source 99. The selector valve 95 is controlled by an actuator 101 adapted to be operated by the operating lever 80 shown in FIG. 2. When the operating lever 80 pushes the actuator 101 rightward, a pipe 102 connected to the fluid supply source 99 communicates with a pipe 103 connected to the cylinder, and thereby the compressed fluid is supplied into the pipes 97 and 98.

In FIG. 8, indicated at 104 is a flow control valve for controlling the flow rate of fluid supplied to the yarn splicing hole. In this embodiment, the compressed fluid is supplied both to the untwisting nozzles and to the yarn splicing hole from the same fluid supply source. However, it is necessary to change the fluid pressure between the untwisting action and the yarn splicing action. That is, the fluid pressure P1 for the untwisting action and the fluid pressure P2 for the yarn splicing action need to meet at least an inequality: $P1 \geqq P2$, to from a satisfactory joint. Therefore, the flow rate is differentiated instead of differentiating the fluid pressure between the fluid for untwisting and the fluid for yarn splicing. In FIG. 8, indicated at 105 is an O-ring and at 106 is a bolt sealing the hollow chamber. The bolt 106 has a round head 107 which pushes the finger 75 of the swing members 47 and 61 shown in FIGS. 5 and 6.

As described in paragraphs (I) and (II), the advancement of the piston rod 74 in one direction controls the fluid supply for yarn splicing and drives the component levers of the yarn end control units.

FIGS. 10 to 13 show another embodiment of the present invention, in which a driving section and a yarn end control units which are different from those of the first embodiment are provided. In this embodiment, a rotary cylinder 110 is employed instead of the linear cylinder employed in the first embodiment. In this embodiment, the fluid supply to the yarn splicing member 1 and to the untwisting nozzles 2 and 3 is controlled by means of a rotary piston 111, and the component levers of the yarn end control units are driven by the rotary motion of a center shaft 112 formed integrally with the rotary piston 111.

Figure 10:
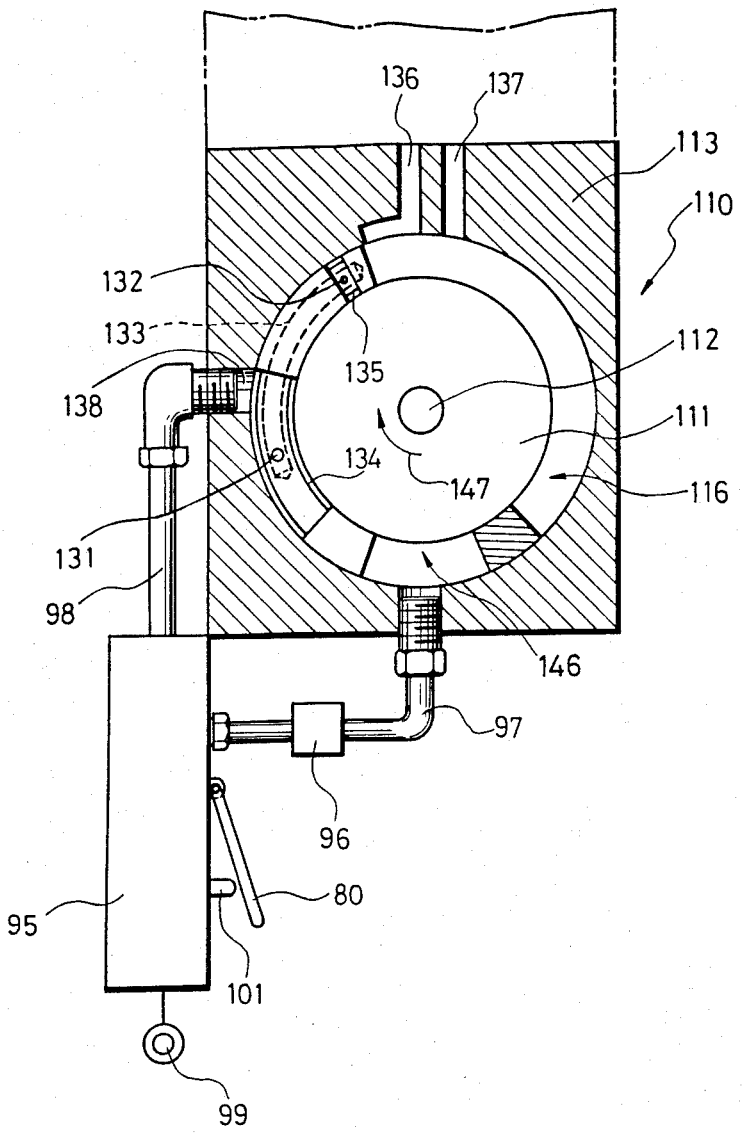
Figure 11:
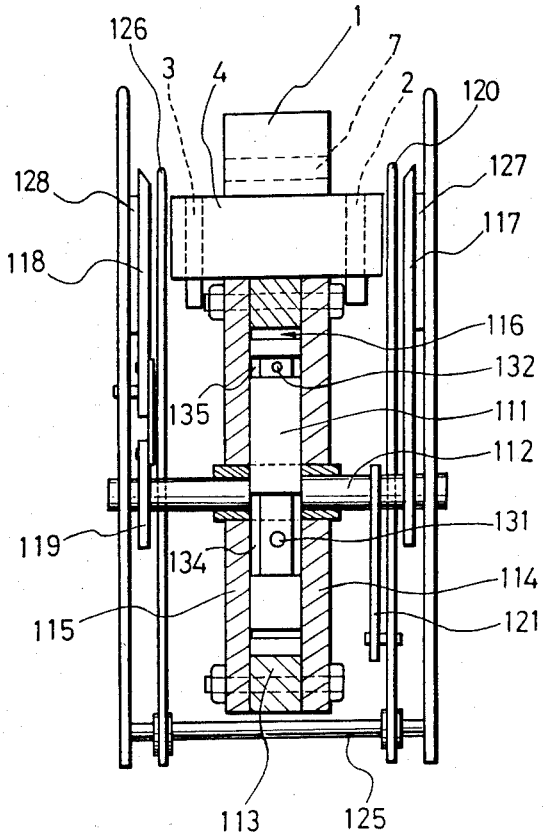
Figure 12:
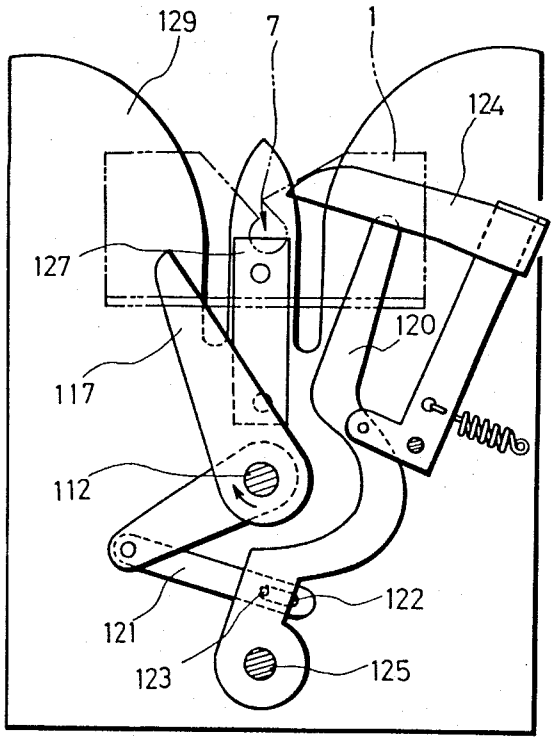
Figure 13:
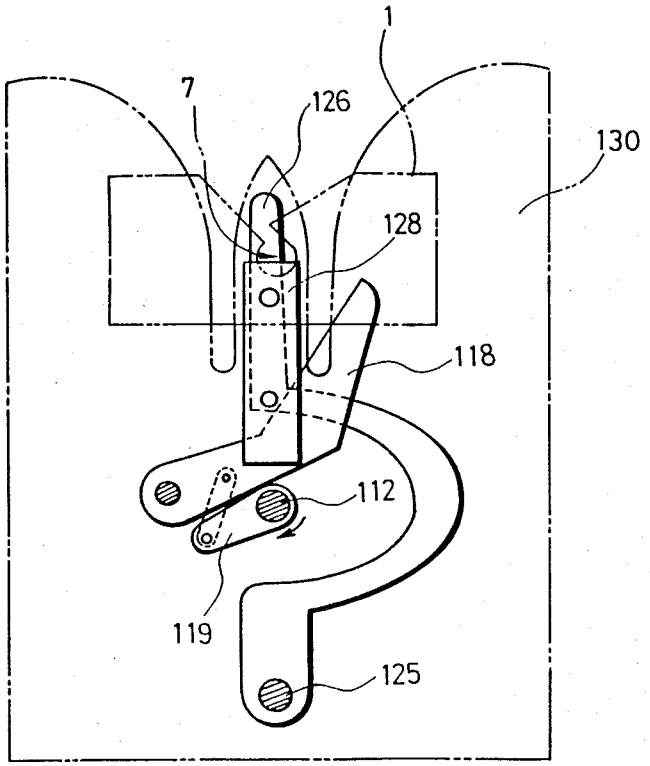

Referring to FIGS. 10 and 11, the rotary piston 111 is fitted rotatably in a cylindrical space 116 formed by a cylinder body 113 and cylinder covers 114 and 115. The shaft 112 formed integrally with the piston 111 penetrates through the covers 114 and 115 and extends on both sides of the cylinder body. A movable blade 117, and a lever 119 for turning a movable blade 118 are fixed directly to the shaft 112. A link 121 linked with a yarn handling lever 120 is fixed to the shaft 112. As shown in FIG. 12, the delayed motion of the link 121 relative to the motion of the movable blade 117 connected through a slot 122 to the yarn handling lever 120 is decided, similarly to the first embodiment, by the position of a pin 123. A yarn holding device 124 is interlocked with the yarn handling lever 120. On the other end of a shaft 125 fixedly supporting the yarn handling lever 120 on one end thereof is fixedly supported another yarn handling lever 126. Thus the yarn handling levers 120 and 126 operate simultaneously. Fixed blades 127 and 128 are fixed to guide plates 129 and 130 so as to constitute, together with the corresponding movable blades 117 and 118, a yarn cutting device.

Referring to FIGS. 10 and 11, a fluid inlet port 131 and a fluid outlet port 132 are formed in the rotary piston 111 of the rotary cylinder 110. The fluid inlet port 131 communicates with the fluid outlet port 132 by means of a connecting bore 133. Grooves 134 and 135 are formed in a positional relation similar to the positional relation between the corresponding ports and grooves in FIG. 9. Indicated at 136 is an opening formed in the cylinder body 113, to supply the fluid to the untwisting nozzles 2 and 3 and at 137 is an opening for supplying the fluid to the yarn splicing hole 7. These openings are provided similarly to the corresponding openings of FIG. 9. The driving section of this embodiment is the same as that of the first embodiment, except that the cylinder of the first embodiment is formed in the form of a circular arc in the second embodiment. Since the output shaft, namely, the center shaft 112, of this embodiment is a rotary shaft, means to convert a linear motion, such as the motion of the linear piston rod, into a rotary motion can be omitted, and hence the device of the second embodiment can be constructed in a further compact construction.

The fluid is supplied from a fluid supply source 99 through a selector valve 95 into pipes 97 and 98, and a speed controller 96 is provided in the pipe 97 connected to the fluid supply port 146 for supplying the compressed fluid to the rotary cylinder 110 to drive the same. This constitution is similar to that of the corresponding system of the first embodiment.

When the actuator 101 of the selector valve 95 is pushed with the driving section in the state shown in FIG. 10, the compressed fluid is supplied through the pipe 97 into the chamber 146, and thereby the rotary piston 111 starts rotating in a direction indicated by an arrow 147. Consequently, the compressed fluid supplied through the pipe 98 and the fluid supply port 138 and the fluid inlet port 131 is distributed through the fluid outlet port 132 to the opening 136 for the untwisting nozzles and the opening 137 for the yarn splicing hole at a predetermined timing and sequence.

The manner of yarn splicing operation of the yarn splicing device shown in FIGS. 1 to 9 will be described hereunder.

Figure 14A:
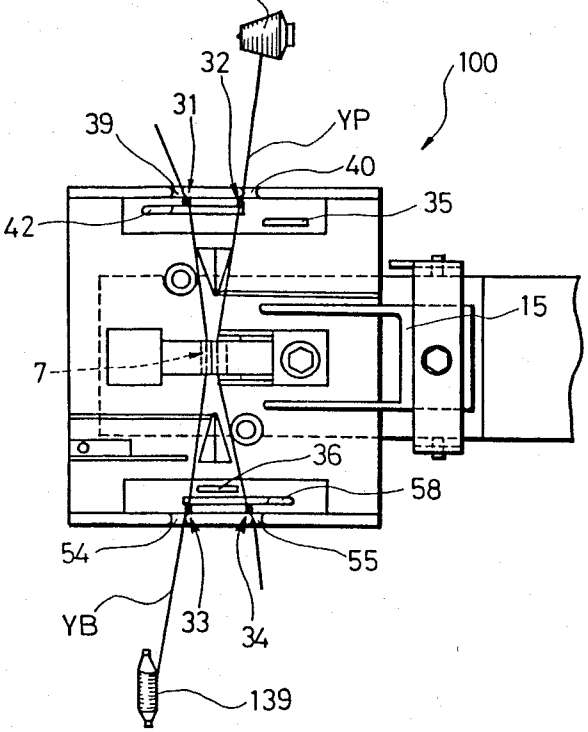
FIGS. 14A to 14D are plan views of the yarn splicing section, showing the sequential steps of the yarn splicing operation.

Refferring to FIG. 14A, in splicing yarns, for example, in a yarn winder, the operator introduces the yarn end YB of a spinning bobbin 139 and the yarn end YP of a package 140 into the predetermined position in the yarn splicing device 100. The yarn end YB of the spinning bobbin 139 is passed through the guide groove 54, the yarn splicing hole 7 and the guide groove 39, and gripped at two positions by the yarn end gripping units 33 and 31. The yarn end YP of the package 140 is passed through the guide groove 40, the yarn splicing hole 7 and the guide groove 55, and gripped at two positions by the yarn end gripping units 32 and 34. During the yarn introducing process, the driving section 300 is in the state shown in FIG. 15A, in which the movable members, namely, the movable blades 42 and 58, the yarn handling levers 35 and 36, and the yarn holding device 15, are in the respective waiting positions.

Then, the operator pushes the actuator 101 of the selector valve 95 by operating the operating lever 80, to start the cylinder 73. Consequently, the compressed fluid is supplied into the chamber 141 and to the fluid supply port 85 (FIG. 8), and thereby the piston rod 74 starts advancing leftward. Consequently, the compressed fluid is supplied to the yarn end control units and the fluid treatment unit at a predetermined timing.

Figures 15A, 15B, 15C, 15D, 15E:
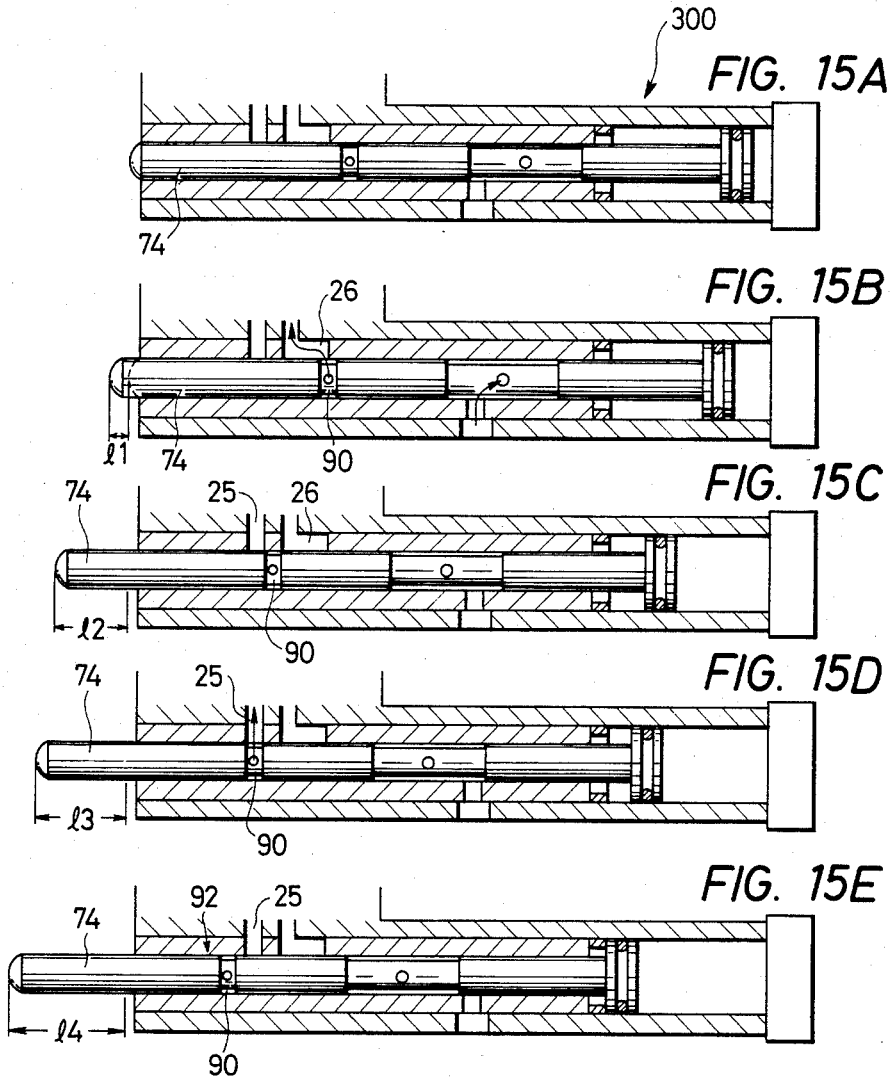
FIGS. 15A to 15E are views corresponding to FIGS. 14A to 14D, showing the variation of the state of the driving unit during the yarn splicing operation.

When the driving section 300 is in a state shown in FIG. 15B, namely, in a state where the piston rod 74 has advanced by a distance $l_1$ from it original position shown in FIG. 15A, the groove 90 is in alignment with the opening 26 for the untwisting nozzles, so that the fluid flows through the sleeve 17 of the untwisting nozzle shown in FIG. 3 in the direction indicated by the arrow 22. Simultaneously, the movable blades 42 and 58 are actuated to cut the yarn ends YB and YP at predetermined positions respectively, and the yarn end YB of the bobbin and the yarn end YP of the package are sucked into the corresponding untwisting nozzles 2 and 3 respectively for untwisting treatment. While the piston rod 74 is advancing further and the groove 90 is within the range of the opening 26, the untwisting action is continued, while the yarn handling levers 35 and 36 are turned to draw out the untwisted yarn ends from the untwisting nozzles.

In the state shown in FIG. 15C, namely, in the state where the piston rod 74 has advanced from the original position by a distance $l_2$, the groove 90 is situated opposite to the wall between the openings 26 and 25. Consequently, fluid supply to the untwisting nozzles 2 and 3 is interrupted and the yarn ends YB and YP are drawn out by a predetermined length from the untwisting nozzles 2 and 3 by the yarn handling levers 36 and 35 respectively, and then the untwisted portions of the yarn ends are overlapped in the yarn splicing hole 7 to wait for the injection of the fluid into the yarn splicing hole 7 for splicing. The yarn holding device 15 has already been moved to the yarn holding position. The operation of the yarn holding device 15 may be caused by the operation of the operating lever 80 by the operator (FIG. 2) or may be interlocked with the operation of the yarn handling lever 120 (FIG. 12). In either case, the yarn holding device needs to be located at the predetermined position as shown in FIG. 14C at least before the piston rod 74 reaches the position shown in FIG. 15C.

In the state shown in FIG. 15D, namely, in the state where the piston rod 74 has advanced further to a position away from the original position by a distance $l_3$, the groove 90 is within the range of the opening 25 for yarn splicing and the fluid flows in the direction indicated by the arrow, and thereby the fluid is injected into the yarn splicing hole. Consequently, the yarn ends are entwined and twisted to be spliced. That is, the yarn end YB of the spinning bobbin and the yarn end YP of the package undergo the action of the swirling current of the fluid injected into the yarn splicing hole 7, and thereby the untwisted fibers are entwined with each other, collected and twisted in the form of a yarn by the twisting action of the fluid, so that a knotless joint is formed. During this yarn splicing operation, the yarn handling levers 36 and 35 remain stopped.

In the state shown in FIG. 15E, namely in a state where the piston rod has advanced further to a position away from the original position by a distance $l_4$, the groove 90 has passed the range of the opening 25 and located opposite the wall 92, and thereby fluid supply to the opening 25 has been stopped. Thus a series of yarn splicing actions are completed. The distance $l_4$ is the total stroke of the piston rod 74, corresponding to the distance (d) in FIG. 9. During the advancement of the piston rod 74 through the differential stroke $l_4-l_2$, the yarn handling levers remain stopped due to the function of the slot 67. After the yarn splicing operation has been completed, the operating lever 80 is returned to the original position to close the selector valve 95 so that fluid supply to the cylinder is interrupted. Consequently, the piston rod 74 is pushed backward through the finger 75 by the force of the spring 76 (FIG. 6) to retract to the original position shown in FIG. 15A. Simultaneously, the yarn handling levers 35 and 36, the movable blades 42 and 58 and the yarn holding device 15 are returned to the respective original positions shown in FIG. 14A.

In the yarn splicing operation, the operator is required only to hold the selector valve 95 or a holder accomodating the selector valve in one hand and to introduce the yarn ends YB and YP into the guide grooves 54, 39 and 40, 55 of the yarn splicing section 100 with the other hand. Then, the yarn ends are gripped between the gripping devices 33, 31 and 32, 34 and located at the predetermined position, and then the yarn ends are spliced together only by pushing the operating lever 80. Thus the yarn ends are spliced through simple operations.

Figure 14B:
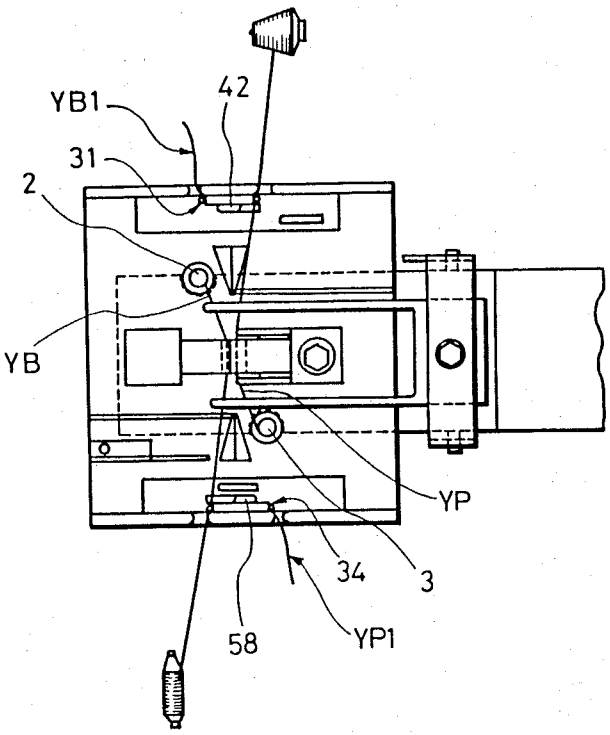
Figure 14C:
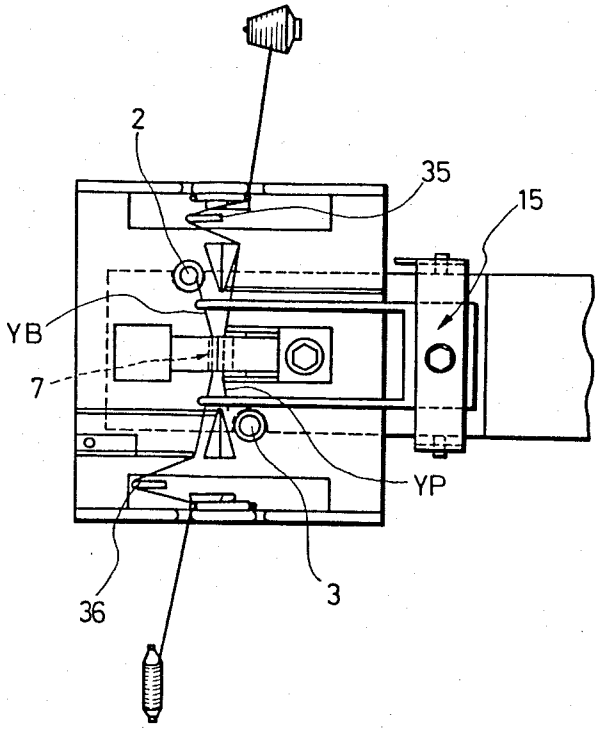
Figure 14D:
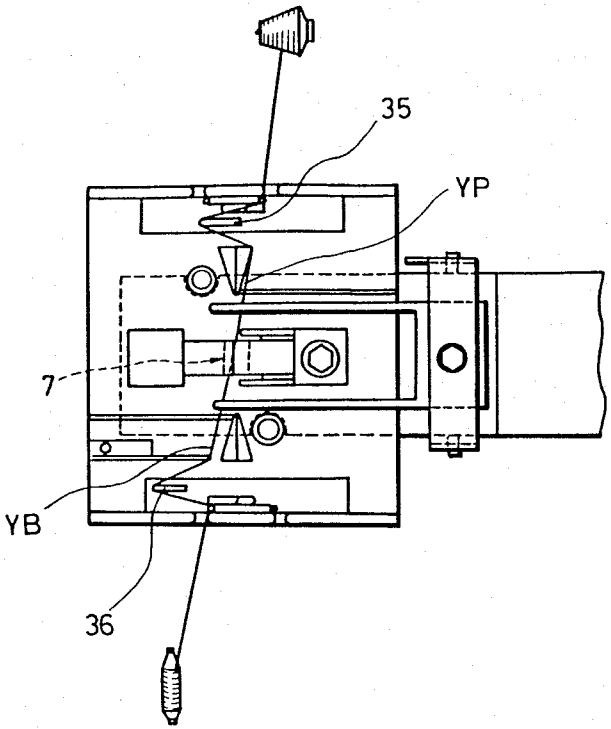

As shown in FIG. 14B, the waste yarns YB1 and YP1 cut off from the yarn ends are gripped by the gripping devices 31 and 34 and will not fall off incautiously. The waste yarns are removed after the completion of yarn splicing operation to prevent the waste yarns from flying.

The yarn splicing time is dependent on the moving speed of the piston rod. For example, when the advancing speed of the piston rod 74 is 20 to 40 mm/sec and the stroke is 30 mm, the actual yarn splicing time, namely, a time from the completion of setting yarn ends to the completion of splicing yarns, is around 0.8 to 1.5 sec. Air or other gas is applicable as the fluid.

What is claimed is:

1. A fluid yarn splicing device comprising:

a fluid treatment unit including a yarn splicing member secured on a block having a yarn splicing hole therein, a fluid exit opening into said yarn splicing hole, and a first fluid supply passage communicating with said fluid exit, a yarn end control unit adjacent said fluid treatment unit and having a yarn cutting device, a yarn handling lever disposed adjacent said yarn splicing member, two swingable hands capable of being positioned between said yarn cutting device and said yarn splicing hole and operating members for driving said yarn cutting device and said yarn handling lever, and a driving section for supplying compressed fluid to said fluid treatment unit and for driving said operating members of said yarn end control unit, wherein said fluid treatment unit further includes a second fluid supply passage, untwisting nozzles for untwisting the ends of yarns to be spliced, said untwisting nozzles being disposed on opposite sides of said yarn splicing member, said untwisting nozzles being formed in said block and communicating with said second fluid supply passage, whereby compressed fluid may be directed thereinto.

2. A fluid yarn splicing device as claimed in claim 1, wherein said driving section comprises:

a cylinder, a piston rod fitted in said cylinder, a tubular body interposed between said cylinder and said piston rod, a fluid supply pipe connected with said cylinder, and a driving means for driving said piston rod with respect to said tubular body.

3. A fluid yarn splicing device as claimed in claim 2, wherein said yarn cutting device includes first and second moveable blades and wherein said operating members of said yarn end control unit include a first swing member for actuating said first movable blade of said yarn cutting device, a second swing member for actuating said second movable blade of said yarn cutting device and said yarn handling lever, a connecting member extended between and fixed to said first and second swing members, and a finger which is fixed to said connecting member and in contact with said piston rod, whereby advancement of said piston rod will cause said swing members to swing.

4. A fluid yarn splicing device as claimed in claim 2, wherein said tubular body is provided with a first opening therein communicating with said first fluid supply passage of said yarn splicing member, a second opening therein communicating with said second fluid supply passage of said untwisting nozzles, and a fluid supply port connected with said fluid supply pipe of said driving section.

5. A fluid yarn splicing device as claimed in claim 2, wherein said piston rod includes a hollow chamber formed therein, a fluid inlet port formed in a first section of said piston rod and a fluid outlet port formed in a second section of said piston rod, said fluid inlet port capable of communicating with said fluid supply pipe and said fluid outlet port capable of communicating with said first opening or said second opening of said tubular body when said piston rod advances with respect to said tubular body.

6. A fluid yarn splicing device as claimed in claim 2, wherein said driving means for said piston rod comprises a fluid supply port formed at the end of said cylinder adjacent said piston rod, a speed controller for controlling the speed of advancement of said piston rod, and a fluid supply source connected to said fluid supply port.

7. A fluid yarn splicing device as claimed in claim 1, wherein said driving section includes a rotary cylinder having a rotary piston therein and a center shaft formed integrally with said rotary piston, whereby the supply of fluid to said yarn splicing member and to said untwisting nozzles is controlled by rotation of said rotary piston and said operating members of said yarn end control unit are driven by the rotary motion of said center shaft.

8. A fluid yarn splicing device as claimed in claim 7, wherein said driving section comprises a cylinder body, said cylinder body having a first opening therein for supplying fluid to said untwisting nozzles, a second opening therein for supplying fluid to said yarn splicing hole and a fluid supply port for supplying compressed fluid to said rotary piston, said rotary piston including a fluid inlet port and fluid outlet port which are connected by a connecting bore and which are capable of communicating with said first opening and said second opening of said cylinder body, respectively, and said center shaft of said rotary piston being fixed to said yarn cutting device and said yarn handling lever of said yarn end control unit.

9. A device for splicing yarn ends comprising:

fluid treatment means for subjecting said yarn ends to the action of compressed fluid, control means for positioning said yarn ends with respect to said fluid treatment means, a control element in mechanical communication with said control means and having at least one fluid passage therein through which fluid may be directed to said fluid treatment means;

drive means for moving said control element at a regulated rate with respect to said control means and said fluid treatment means;

whereby said regulated movement of said control element governs operation of the said fluid treatment means and said control means.

10. A device as in claim 9 wherein the speed at which said drive element moves with respect to said fluid treatment means determines the length of time during which said yarn ends are subjected to the action of compressed fluid by said fluid treatment means.

* * * * *